US008366112B1

(12) United States Patent
Nasibyan

(10) Patent No.: US 8,366,112 B1
(45) Date of Patent: Feb. 5, 2013

(54) AUTOMATED BLACKJACK TABLE

(76) Inventor: Tigran Nasibyan, Erie, PA (US)

( * ) Notice: Subject to any disclaimer, the term of this patent is extended or adjusted under 35 U.S.C. 154(b) by 0 days.

(21) Appl. No.: 13/585,633

(22) Filed: Aug. 14, 2012

(51) Int. Cl.
*A63F 1/06* (2006.01)

(52) U.S. Cl. ..... 273/309; 273/280; 463/36; 463/46

(58) Field of Classification Search ..... 273/309, 273/280, 292; 463/36, 46
See application file for complete search history.

(56) References Cited

U.S. PATENT DOCUMENTS

| | | | | |
|---|---|---|---|---|
| 462,933 | A * | 11/1891 | Sanderson et al. | 108/26 |
| 1,669,671 | A * | 5/1928 | Owens | 108/104 |
| 6,382,630 | B1 * | 5/2002 | Dos Santos et al. | 273/309 |
| 7,264,551 | B2 * | 9/2007 | Ghahraman | 473/16 |

* cited by examiner

*Primary Examiner* — Benjamin Layno
(74) *Attorney, Agent, or Firm* — Richard K Thomson

(57) ABSTRACT

An automated blackjack table features a rotating ring with numbered stations (up to 21) matching the numbers at which the players are positioned. By pressing a foot pedal, the dealer can rotate the ring and rapidly deal a card to each passing numbered station allowing the density of players (and, hence the revenue stream) at each table to be tripled.

3 Claims, 3 Drawing Sheets

AUTOMATED BLACKJACK TABLE

BACKGROUND AND SUMMARY OF THE INVENTION

The present invention is directed to gaming equipment. More particularly, the present invention is directed to an automated blackjack table which will enable casinos to significantly increase revenues from each of its blackjack tables.

Currently, each dealer can reasonably accommodate seven players at her/his blackjack table. The dealer is thus limited in spite of the fact that, typically, multiple-deck shoes from which s/he deals have 4, 6, 8 or more decks which could easily allow 20 or more players to participate in any given hand. The limit is not a result of the availability of cards; the limit is a practical one: a dealer can only reasonably keep track of up to seven gamblers at a time. To try to include more would require the dealer to turn her/his back on the other players which could afford opportunity for tampering with the cards/bets.

It is among the objects of the present invention to permit a casino to significantly enhance the efficiency of its dealers and, hence, the revenue stream to the house by providing an automated table. The blackjack table of the present design has a rotating ring with numbered stations that correspond to the numbered player stations around the exterior of the table. The dealer can actuate the rotation of the ring rapidly deal hands on top of each number on the ring for each player present (as indicated either by an electronic light system or a manual chip system) and reposition the ring to present each player with her/his hand. Once the initial bets have been placed, the dealer activates a series of retractable windows which eliminates the players' access to the cards and initial bets which have been placed. S/he then moves the sliding dealer's station from player to player completing the hand as s/he otherwise would. When the dealer deals her/his own hand, the digital camera projects the hand onto a plurality of monitors so that each player is able to see and assess whether her/his own hand is a winner or not. The dealer then collects the bets and cards into recesses in the dealer station and prepares for the next hand by lowering the windows.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
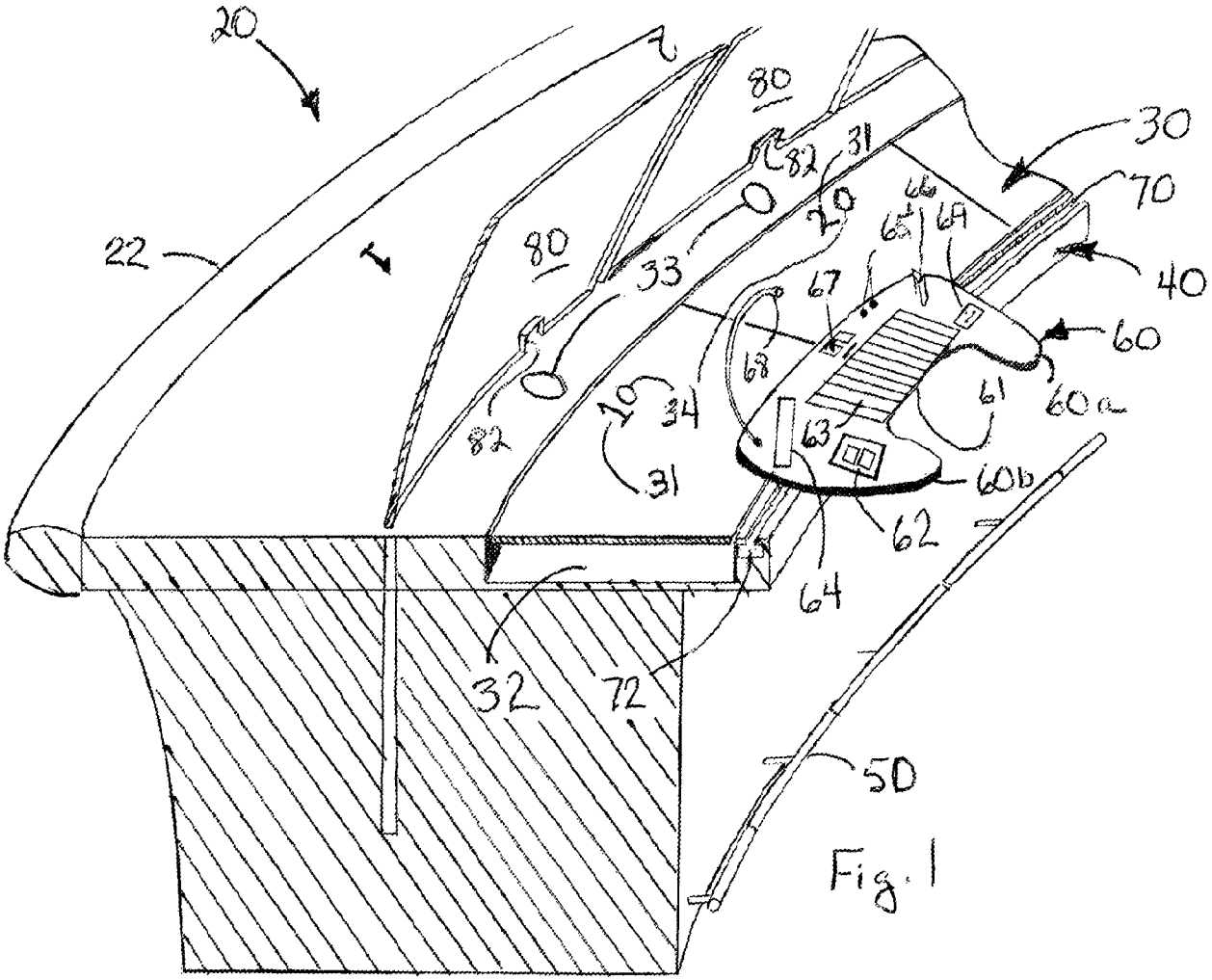
FIG. 1 is a perspective side view of a first embodiment of the rotating blackjack table of the present invention in partial section.
Figure 2:
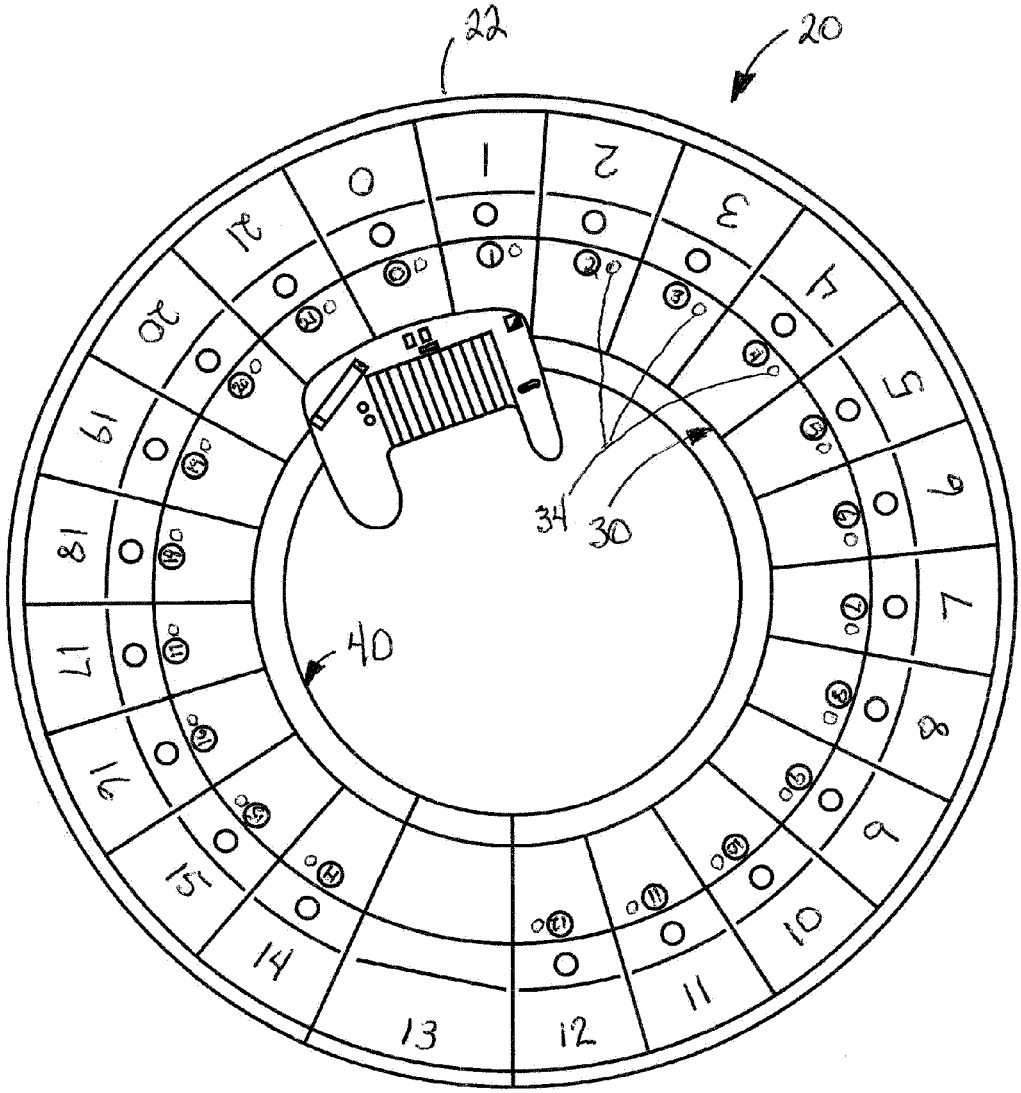
FIG. 2 is a top view of the first embodiment.

A first embodiment of the rotating blackjack table of the present invention is depicted in FIGS. 1-2 generally at 20. An outer stationary table portion has 22 stations numbered 0 to 21 with station 13 being a non-operational station comprising a liftable folding door for entry and exit by the dealer. A center rotating ring table portion 30, with a like number of numbered stations 31 numbered 0 to 21 corresponding to the outer table portion 22, rotates through 360° in channel 32 positioned between outer table portion 22 and stationary inner table portion 40. Optionally, each station 0-21 (except non-operational station 13) can be equipped with a light 34 on rotating table portion 30 which will illuminate when a player is seated at a particular station. A lower tech (and therefore, a lower cost) version of the table 20 will be operated using manual chips/markers each player will place adjacent the rotating number 31 to indicate her/his desire to be dealt in. A foot pedal 50 energizes switch 51 allowing the dealer to rapidly deal the up-to-twenty-one hands by activating motor 35 (FIG. 3) which drives rotating table portion 30 so s/he simply deals one card on each occupied station as ring 30 rotates in a counterclockwise direction. Rotating table portion 30 can be friction driven by one or more wheel(s), belt(s), or a rack and pinion (not shown). Initial bets are placed in zones 33. Drive motor 35 will be a reversible, variable speed motor, engagement with foot pedal 50 controlling the rate of rotation by the amount of downward force for counterclockwise rotation and lifting up to effect clockwise rotation.

Dealer station 60 has one or more T-shaped fasteners (not shown) on its lower surface 61 which are received in T-shaped slot 72 in slide rail 70. Dealer station 60 is equipped with a shuffling machine 62, a rack 63 for storing chips, a shoe 64 from which the cards are dealt, a pair of buttons 65' for activating electrical switch 65 (FIG. 3) for raising and lowering window 80, a region 66 for receiving expended cards, a drop box 69 for receiving tip money, a surface 67 which receives the dealer's hand, and a digital camera 68 focused on the dealer's hand so that all players can simultaneously see whether they have won or lost by gazing at the TV monitors (not shown) positioned about the table 20.

A retractable window 80 is positioned between the dealer and player having a narrow slot 82 to allow a player to make an additional bet. Window 80 is initially down allowing the player to ante her/his initial bet. Once the initial activity is completed, the dealer activates switch 65 to raise window 80 preventing tampering with the bets/cards until the hand has been completed.

At this point, the dealer slides the dealer station 60 around the inner circumference of the table 20 by contacting ear **60*a* with her/his hip, asking each player if they want another card or to "stay". Once the dealer has completed the trip about the table, s/he deals her/his own hand and determines winners, whom s/he pays, and losers whose cards and bets s/he claims. The dealer may move dealer station 60 in the opposite direction by pushing ear 60*b*** with her/his left hip in a counterclockwise direction.

Figure 3:
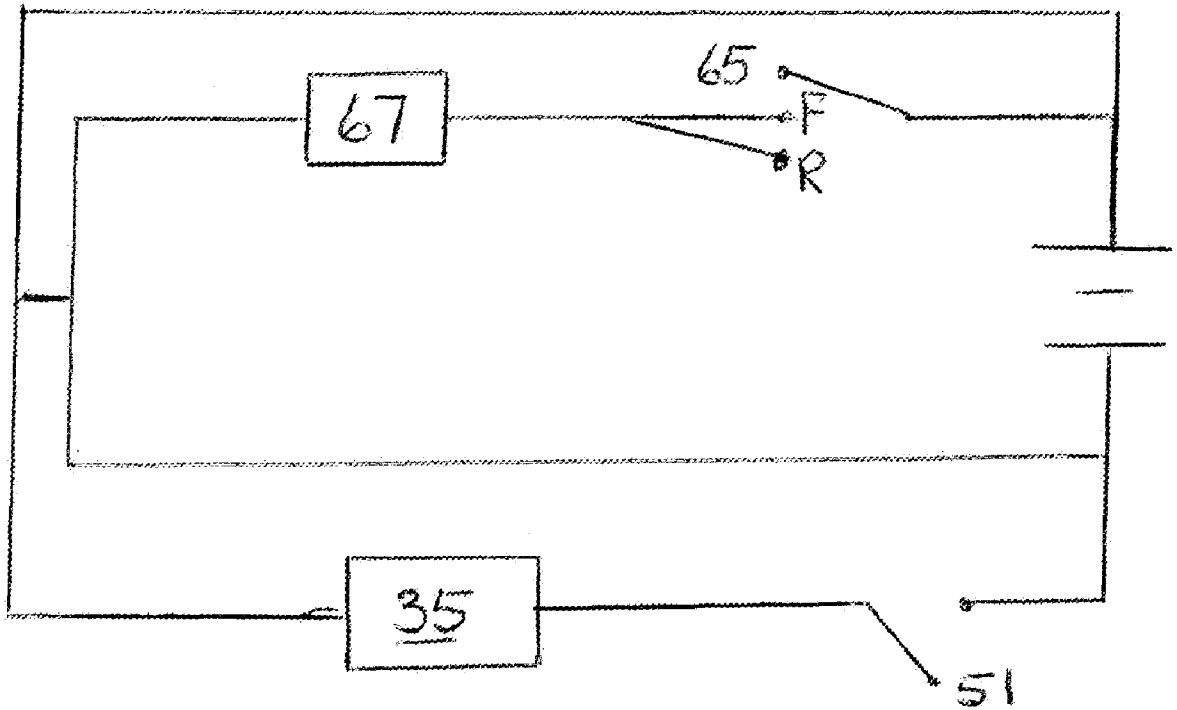
FIG. 3 is a schematic of the electrical and hydraulic system of the first embodiment.

As shown in the electrical/hydraulic schematic of FIG. 3, activation of foot pedal 50 energizes motor 35 such that rotating ring portion 30 rotates through 360° as the dealer rapidly distributes the cards to each player present, skipping the numbered stations where no player, s/he eventually arrives back to "square one", where the numbered stations on the rotation ring table portion 30 match the numbered stations on stationary table portion 22. After the dealer announces that betting is closed, s/he activates switch 65 to raise window 80. Dealer begins with the first player at station 0 playing the hand asking the player if s/he wants a card or to stay, moving the dealer station 60 around the inner periphery of table 20 by engaging her/his hip with ear **60*a*, until all hands have been completed, raking in bets and cards of those players who have gone bust. When all hands are complete, the dealer plays her/his hand, the dealer's hand being televised by digital camera 68 to monitors (not shown) positioned above the table so that all players simultaneously see the dealers cards and know their status (won/lost). The dealer then pays the winning hands, rakes the losing bets, and retrieves the cards to prepare for the next hand. It will be understood that switch 65 can energize a solenoid 67 to raise/lower (forward F, reverse R) window 80. Alternatively, switch 65** can activate a pneumatic or hydraulic cylinder to accomplish window movement.

The rotating table 20 allows an increased density for each blackjack table enhancing the profitability to the establishment, since the odds are always with the house. It will be readily apparent that the rotating table 20 of the present invention allows a blackjack table to accommodate 3 times the normal table and requires only a slight additional amount of time to triple the income.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An automated blackjack table having a plurality of player stations, said blackjack table comprising:

a) a stationary outer table portion featuring a first plurality of player stations, each station having a first number;

b) a stationary inner portion featuring a rail;

c) a 360° rotating table ring portion having a second plurality of player stations, each station having a second station number which corresponds to said first number;

d) motor means for powering said rotating table portion to rotate at dealer's discretion throughout a range of 360°;

e) a dealer station slidable on said rail of said stationary inner portion.

2. The automated blackjack table of claim 1 further comprising a plurality of retractable windows which are extended from the stationary outer table to prevent players from tampering with their hands and bets.

3. The automated blackjack table of claim 2 wherein each said retractable window includes a slot through which a player may insert money when increasing her/his bet from an initial bet.

* * * * *